US007475716B2

(12) United States Patent
Hunter et al.

(10) Patent No.: US 7,475,716 B2
(45) Date of Patent: Jan. 13, 2009

(54) FOUNDRY MOLD HANDLING SYSTEM WITH MULTIPLE DUMP OUTPUTS AND METHOD

(75) Inventors: William A. Hunter, Naples, FL (US); William G. Hunter, North Barrington, IL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 383 days.

(21) Appl. No.: 10/976,606

(22) Filed: Oct. 29, 2004

(65) Prior Publication Data

US 2005/0109478 A1 May 26, 2005

Related U.S. Application Data

(60) Provisional application No. 60/520,583, filed on Nov. 17, 2003.

(51) Int. Cl.
*B22D 2/00* (2006.01)
*B22D 46/00* (2006.01)
*B22C 19/04* (2006.01)

(52) U.S. Cl. ..... 164/4.1; 164/150.1; 164/154.1; 164/323

(58) Field of Classification Search ..... 164/4.1, 164/150.1, 154.1, 323, 324
See application file for complete search history.

(56) References Cited

U.S. PATENT DOCUMENTS

| | | | | |
|---|---|---|---|---|
| 3,794,152 | A * | 2/1974 | Reyland | 198/431 |
| 3,827,549 | A | 8/1974 | Hunter | |
| 4,589,467 | A | 5/1986 | Hunter | |
| 5,125,448 | A * | 6/1992 | Jensen | 164/155.1 |
| 5,894,005 | A * | 4/1999 | Steel et al. | 264/40.1 |
| 5,901,774 | A | 5/1999 | Hunter et al. | |
| 5,927,374 | A | 7/1999 | Hunter et al. | |
| 5,971,059 | A | 10/1999 | Hunter et al. | |
| 6,145,577 | A | 11/2000 | Hunter et al. | |
| 6,216,767 | B1 * | 4/2001 | McMellon | 164/324 |
| 6,622,772 | B1 | 9/2003 | Hunter | |

* cited by examiner

*Primary Examiner*—Kevin P Kerns
(74) *Attorney, Agent, or Firm*—Leydig, Voit & Mayer, Ltd.

(57) ABSTRACT

A mold handling system for carrying and transporting sand molds comprises a mold handling conveyor with multiple mold exits to provide different outputs for the sand molds. The mold handling system may include flags which can be used to mark selected molds to segregate the sand molds into different groups. A control system responds to flag sensors and tracks the molds to selectively control output of sand molds through the mold exits. Methods of handling sand molds using a mold handling system are also disclosed.

28 Claims, 6 Drawing Sheets

10
66
42
46
68
14
70
24
72
58
46
14
16
36
100c
44
100a
19
34
36
32
28
100b
20
20
26

74
10
100c
42
100a
100b
46
64
14
70
22
75
46
14
62
36
44
60
34
32
20
30
20
26
28

FOUNDRY MOLD HANDLING SYSTEM WITH MULTIPLE DUMP OUTPUTS AND METHOD

CROSS-REFERENCE TO RELATED PATENT APPLICATIONS

This patent application claims the benefit of U.S. Provisional Patent Application No. 60/520,583, filed Nov. 17, 2003.

FIELD OF THE INVENTION

This invention pertains to foundry equipment and methods, and more particularly to foundry mold handling systems and methods for handling sand molds.

BACKGROUND OF THE INVENTION

Examples of mold handling systems are disclosed in the following U.S. Pat. No.: 3,827,549 to Hunter entitled "Extended Cooling Conveyor"; U.S. Pat. No. 4,589,467 to Hunter entitled "Mold Handling System"; U.S. Pat. No. 5,901,774 to Hunter et al. entitled "Linear Mold Handling System With Double-Deck Pouring And Cooling Lines; U.S. Pat. No. 5,927,374 to Hunter et al. entitled "Manufacturing Sand Mold Castings"; U.S. Pat. No. 5,971,059 to Hunter et al. entitled "Molding And Casting Machine"; and U.S. Pat. No. 6,145,577 to Hunter et al. entitled "Linear Mold Handling System"; and pending patent application Ser. No. 10/133,824 entitled "Method for Forming Sand Molds and Matchplate Molding Machine for Accomplishing Same"; all of which are assigned to the present assignee, and all of which are hereby incorporated by reference.

As disclosed in the foregoing patents, mold handling systems receive sand molds from one or more sand molding machines and then convey molds in an organized manner on a conveyer system to allow for pouring of molten material into sand molds and/or cooling of molten material poured into sand molds. The mold handling systems are typically interposed between a mold making machine and a shakeout conveyor where harvest of castings occurs. Mold handling systems may include rotary conveyors as disclosed in the '467 patent or linear conveyors as disclosed in the '549, '774, '374, '059 and '577 patents.

While these foregoing patents disclose significant technological innovations and improvements in the mold handling system art and have advanced automation in the mold making industry, there are still deficiencies existing with the apparatus and methods associated with making and handling sand molds to produce metal castings. One issue is that problems with the formation of sand molds or quality problems with castings being formed may not be discovered until a late stage. For example, each time a metallurgical mixture of molten metal is created in a ladle, it often takes a long time, typically more than an hour, for lab tests to determine if the metal poured from each ladle is of an acceptable metallurgical characteristic. There are other reasons such as mold flask, matchplate or squeeze head problems at the sand molding machine that may create improperly shaped internal cavities in the sand molds. As a result, defective castings or waste product may be produced and not discovered until a late stage.

As a result, defective castings may be mixed with good quality product when the castings are output and then harvested on the shakeout conveyor.

BRIEF SUMMARY OF THE INVENTION

It is a general objective of the present invention to provide a better way to address molding/casting problems that occur in foundry molding systems.

One aspect of the present invention is directed toward a method for processing and handling sand molds produced at a sand mold forming station in which sand molds are transported with a mold handling system, molten material is poured into the sand molds to form castings, and molds of different mold characteristics are outputted through different mold exits.

According to a further aspect, the inventive method includes segregating the sand molds into at least two groups and tracking the at least two groups of sand molds as the sand molds are transported by the mold handling system. The at least two groups of sand molds are selectively outputted from the mold handling system through one of at least two different mold exits.

Another aspect of the present invention is directed toward a foundry mold handling system for handling sand molds formed at a sand mold forming station. According to this aspect, the mold handling system includes a mold handling conveyor having a mold inlet adapted to receive sand molds from the sand mold forming station in which the mold handling conveyor is adapted to convey sand molds. The mold handling system includes at least two mold exits for the mold handling conveyor. Means is provided for selectively dumping sand molds at the multiple mold exits.

According to further aspect of the present invention, a foundry mold handling system is provided with at least two mold exits in which a first mold actuator is operable to dump sand molds to a first mold exit, and second mold actuator operable to dump sand molds to a second mold exit. Depending upon output elevation, dump chutes may be provided to assist in guiding sand molds to exit locations.

According to a further aspect of the present invention, flag elements are provided for marking selected molds to provide for selective segregation of molds into groups. Molds can be selectively dumped through selected mold exits based upon grouping.

According to yet a further aspect of the present invention, an electronic controller is provided to monitor conveyor movement and track molds as the molds progress along the conveyor. The electronic controller is operable to automatically direct molds to the appropriate mold exit based upon input parameters.

DETAILED DESCRIPTION OF THE INVENTION

Figure 1:
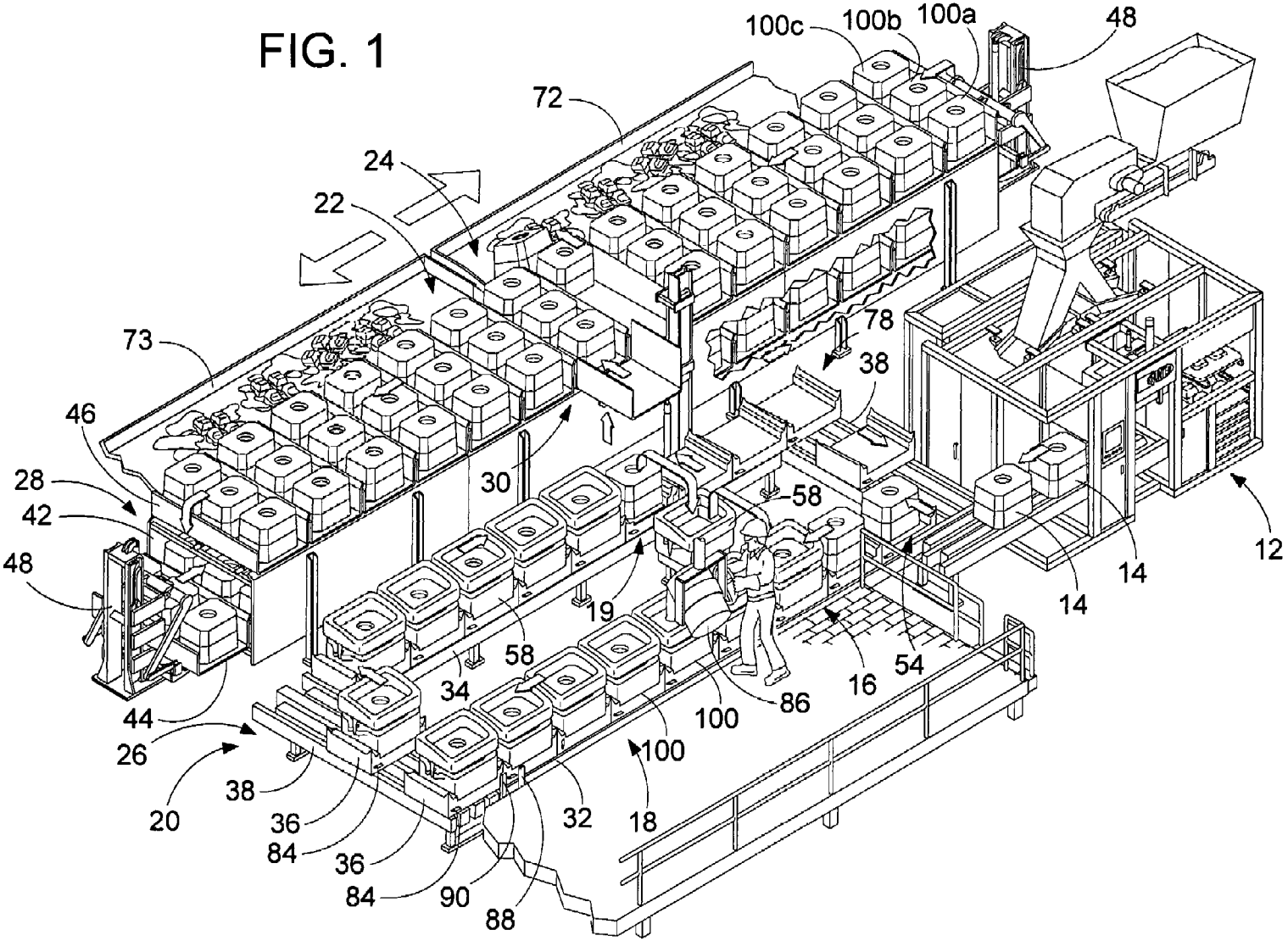
FIG. 1 is a perspective view of a mold handling system according to an embodiment of the present invention, with certain components stripped away and mold flow arrows added to facilitate a greater understanding of the present invention, and in which the mold handling system is connected to a mold forming station.
Figure 2:
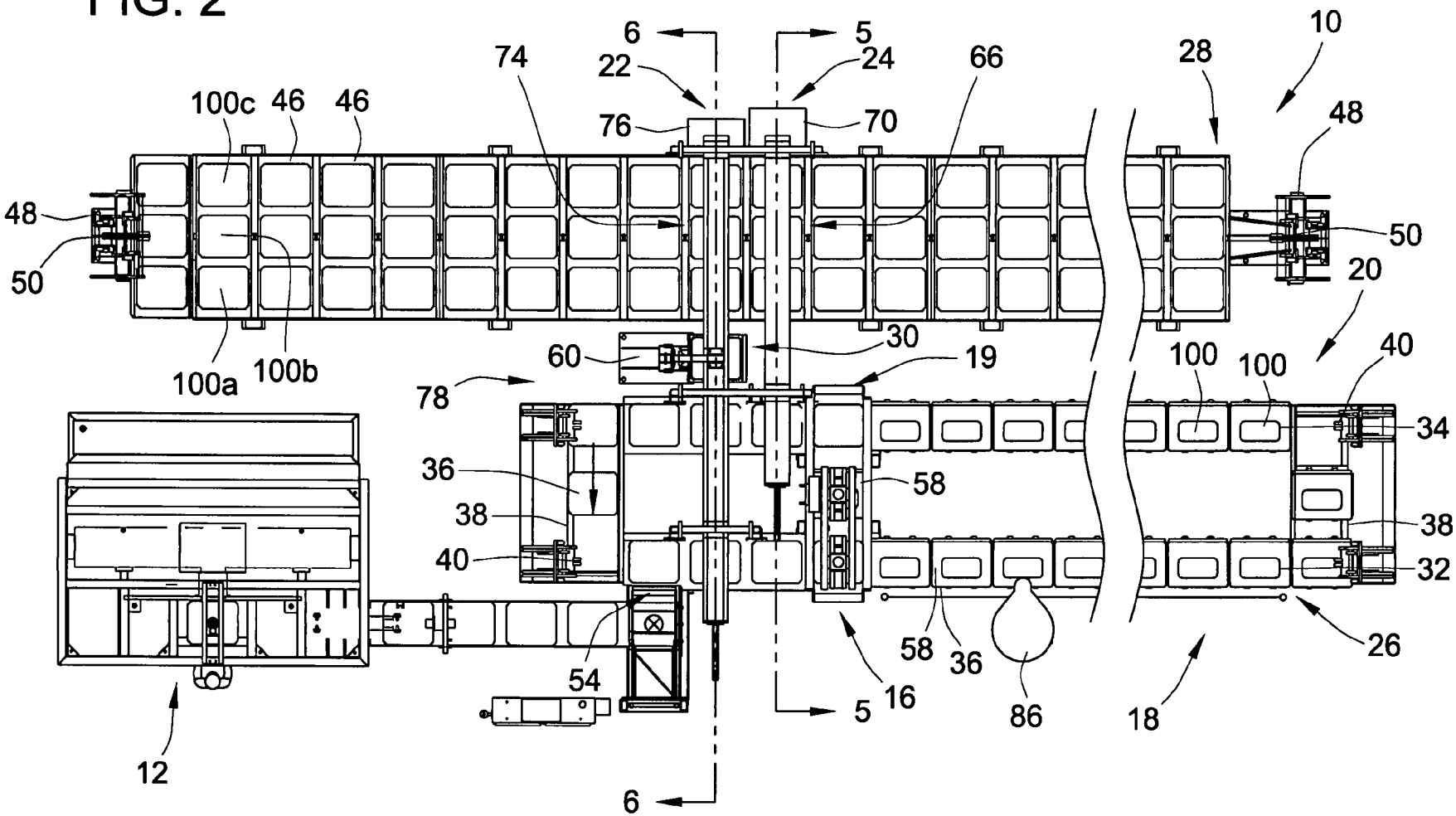
FIG. 2 is a plan view of the mold handling system shown in FIG. 1.
Figure 3:
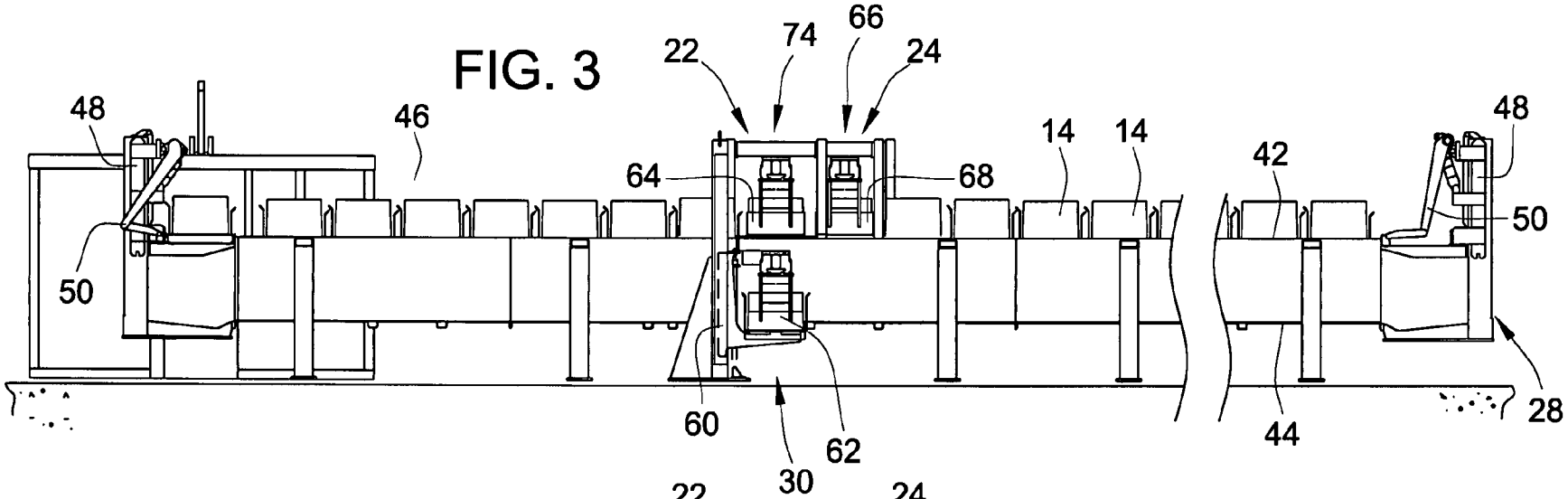
FIG. 3 is a side elevation view of the mold handling system shown in FIG. 1.
Figure 4:
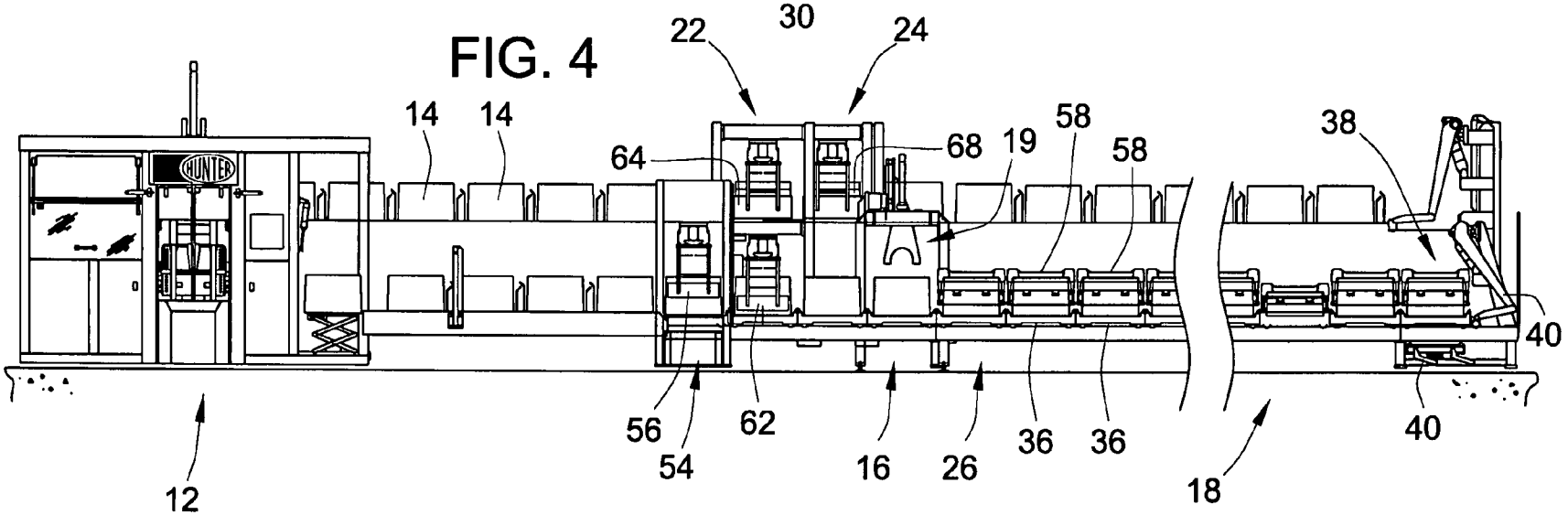
FIG. 4 is a side elevation view of the cooling conveyor for the mold handling system shown in FIG. 1.

Referring no to FIG. 1, an embodiment of the present invention is generally depicted as a sand mold handling system 10 that is connected to a mold forming station 12 whereat sand molds 14 are formed. The sand mold forming station 12 is shown as an automatic matchplate mold making machine, which may be a machine as disclosed in pending U.S. application Ser. No. 10/133,824 to Hunter, which is hereby incorporated by reference in its entirety. In the molding machine, sand is compressed within a mold flask about a matchplate. This machine may be configured to be readily capable of changing matchplates or other sand mold forming parameters (e.g. squeeze and blow settings) during continuous operation to form molds with differing mold characteristics. The sand mold handling system 10 generally comprises a weight and jacket installation station 16, a pouring station 18, a weight and jacket removal station 19, mold handling conveyor 20 and a discharge station, which contrary to the prior art, is comprised of two or more mold exits, and in this case two mold exits including a first mold exit 22 and a second mold exit 24, which provide for different output possibilities (the use of "first" and "second" are used herein for purposes of numeric differentiation and are to be construed as meaning at least two or more).

Referring to the mold handling conveyor 20, the disclosed embodiment includes a separate pouring conveyor 26 and a cooling conveyor 28. A mold transfer mechanism 30 is disposed between the pouring and cooling conveyors 26, 28 to transfer molds from the pouring conveyor 26 to the cooling conveyor 28. Although a preferred embodiment is illustrated, it will be appreciated by those skilled in the art that the present invention is applicable and may be incorporated in different types of mold handling conveyors such as those disclosed in the patents noted in the background section above or in other appropriate mold handling conveyor arrangements.

The pouring conveyor 26 includes a front track 32 and a parallel back track 34 that transport a predetermined number of mold carriers shown in the form of pouring pallets 36 along an endless path around the front and back tracks 32, 34. Pouring pallets 36 move in a first direction along the front track 32 and return in an opposite direction along the back track 34. Lateral transfer mechanisms at the ends of the tracks 32, 34 shift pouring pallets 36 perpendicularly between the front and back tracks 32, 34. Indexing actuators 40 at the ends of the tracks 32, 34 are adapted to index the pouring pallets 36 along the endless path.

The cooling conveyor 26 includes upper and lower tracks 42, 44 that carry a predetermined number of mold carriers shown in the form of mold trays 46 along an endless path. The lower track 44 is disposed under the upper track 42. Elevators 48 at the ends of the tracks 42, 44 transfer mold trays 46 vertically between the upper and lower tracks 42, 44. Indexing actuators 50 at the ends of the tracks 42, 44 are adapted to index the mold trays 46 along the endless path. In the disclosed embodiment, the molds trays 46 are shown to receive three molds side by side for parallel movement. Depending upon the amount of cooling time desired for the overall system, each mold tray 46 can be sized to receive fewer or more molds to meet customer requirements.

Newly formed sand molds 14 exit the mold forming station 12 and enter the mold handling conveyor 20 through a mold inlet 54. The mold inlet 54 is provided along the pouring conveyor 26. A hydraulic push ram 56 is adapted to push molds 14 through the mold inlet 54 onto empty pouring pallets 36. After molds 14 are positioned on a pouring pallet 36, the pouring pallets 36 (and therefore the molds 14) are indexed first through the weight and jacket installation station 16 whereat the molds 14 are fitted with a weighted jacket 58, then through a pouring station 18 (which is a selected section of the pouring conveyor 26 where pouring operations are performed), and then after being subjected to sufficient cooling, to the weight and jacket removal station 19. The weight and jacket removal station 19 is adjacent the weight and jacket installation station 16 to provide for ready removal and reuse of weighted jackets 58.

Once the weighted jackets 58 are removed, molds are transported to the cooling conveyor 28 via the transfer mechanism 30. The transfer mechanism 30 is disposed just downstream of the weight and jacket removal station 19 between the pouring and cooling conveyors 26, 28. The transfer mechanism 30 is adapted to transfer sand molds 14 from the pouring pallets 36 onto the mold trays 46. To accomplish this task and to elevate the molds to the upper track 42, the transfer mechanism 30 includes an elevator 60 and a pair of actuators shown as hydraulic push rams 62, 64. The first push ram 62 linearly reciprocates to push molds off of the pouring pallets 36 and onto the mold elevator 60. The second push ram 62 linearly reciprocates to push molds 14 to any of the receiving locations on the mold trays 46. The second push ram 62 is operable to push molds to any of the receiving locations 100*a*, 100*b*, 100*c* on the mold trays 46, such that each tray can be completely filled with molds 14 prior to indexing the trays 46 around the cooling conveyor 28 when maximum cooling cycle time is desired.

As the molds 14 are indexed and conveyed around the cooling conveyor 28, the castings in the molds cool and hardened as heat is dissipated. For ordinary operation and after one full cycle around the cooling conveyor 28, the molds have cooled sufficiently to allow for harvest of castings. At the end of the indexing cycle, at the output station 66 comprising an actuator shown in the form of a hydraulic push ram 68 is provided to output and push all three molds 14 that are carried on a full mold tray 46 off the cooling conveyor 28 through a dump chute 70 and to the second mold exit 24, whereat a shakeout conveyor 72 (or transport conveyor leading to a shakeout conveyor) is provided to break apart the molds for the harvest of metal castings. The dump chute 70 may be used to assist in guiding molds to the second mold exit 24.

In accordance with the present invention, an additional first mold exit 22 is provided upstream of the second mold exit 24 to provide an additional mold output station 74 with an additional dump chute 76 provided to offload molds from the cooling conveyor 14. In the disclosed embodiment the first mold exit 22 is arranged in line with the transfer mechanism 30 such that the previously referenced hydraulic push ram 64 utilized to load molds 14 onto trays, is also operable to push molds all the way through the tray 46, through the chute 76 and through the first mold exit 22 to provide for an alternative output option. Although not shown, it will be appreciated that additional mold exits and output stations may be provide or alternative exit and output station locations may be provided. Output stations and exits locations may be provided for example on the pouring conveyor, for example at the pouring conveyor end 78 after unjacketing of molds has occurred.

By providing multiple mold exits 22, 24, several new conveyor operational modes and mold handling processes can be and are enabled. According to one embodiment, the first mold exit 22 is used for first mold inspection. Periodically or when a change in an operational parameter at the mold forming station 12 occurs, the first mold subject to such a change a "first" mold characteristic can be poured and then pushed right through the mold tray 46 and the dump chute 76 to the first mold exit 22. Then, the castings formed by the first mold can be quickly inspected to ensure adequate casting quality and/or to identify sand mold forming problems. Changes at the mold forming station 12 can occur when blow, squeeze or fill parameters are adjusted, or when matchplates or molding patterns are switched thereby changing a pattern parameter. Problems such as improper alignment or improper squeeze or blow parameters can sometimes occur at mold forming station 12.

By pushing the first mold through the cooling conveyor 28 without cycling the first mold around the cooling conveyor for the first mold inspection, the first mold effectively bypasses the cooling conveyor 28 and therefore bypasses a majority of the mold locations that the test mold would otherwise systematically cycle through. Thus, the castings formed by the first molds can be examined quickly before a large number of molds have been made. If there is a casting quality problem, then the problem can be readily remedied without the need to fill the cooling conveyor 28 with potentially problematic molds. Further, if there is a molding problem, all of the problematic molds can be identified as waste product or low quality product and directed to the first mold exit 22 for recycling or other appropriate use. This avoids mixing of problematic castings with quality castings.

Although the disclosed embodiment provides for automated mold tracking and segregation (as will be discussed further below), a more simplistic way to provide for first mold inspection is to manually track the first mold running through the system. The first mold may be visually flagged such as by spraying the mold with spray paint or tagging the mold for easy identification. Manual input 80 may be used to override the typical cycling of the first test mold around the cooling conveyor 28 to control the hydraulic ram 64 of the transfer mechanism 30 to push the first mold through the first mold exit 22 for inspection.

Figure 7:
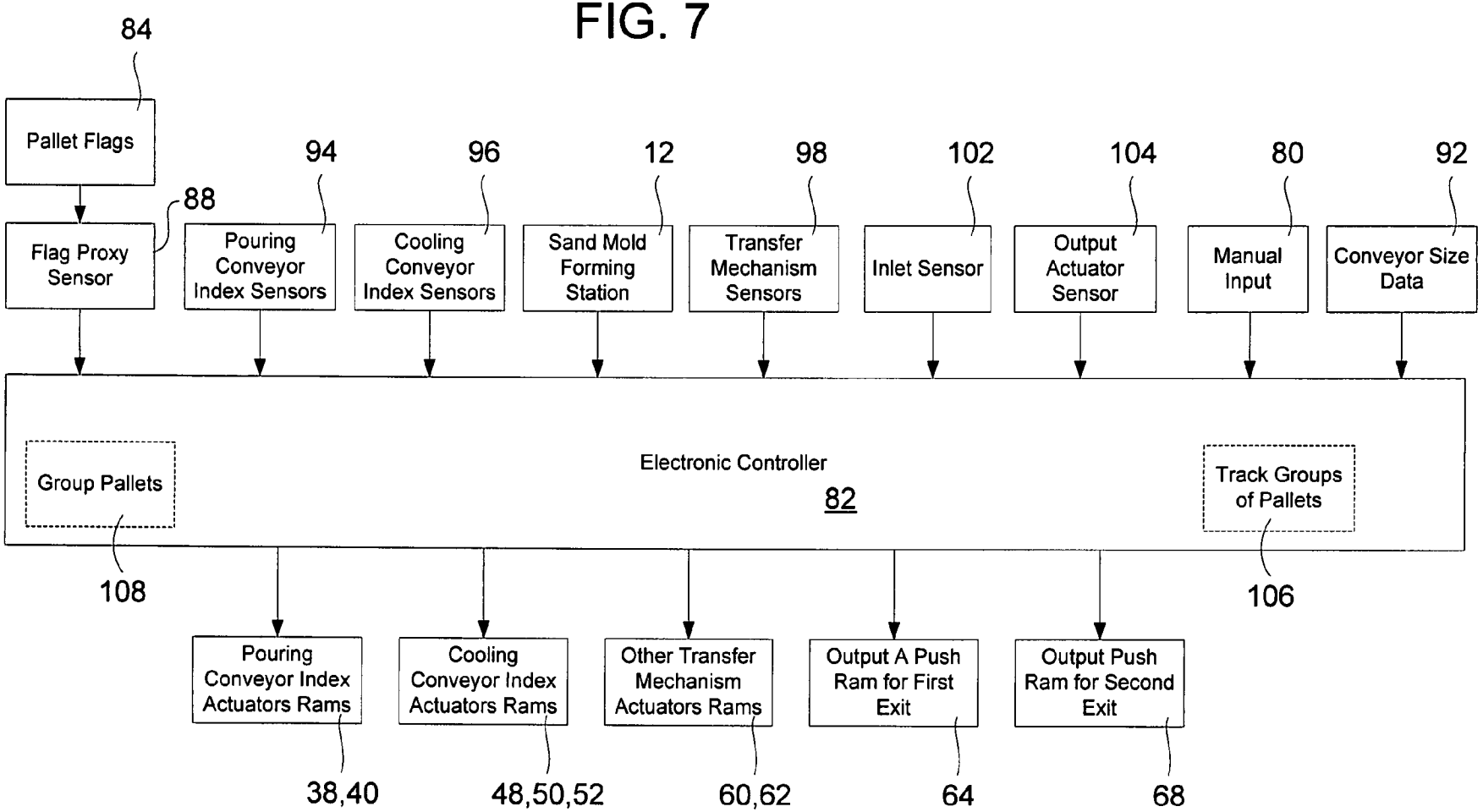
FIG. 7 is control schematic diagram for the mold handling system shown in FIG. 1 according to an embodiment of the present invention.

According to the disclosed embodiment and another aspect of the present invention, automation of the mold handling system 10 is provided to automatically track and segregate the molds. This is schematically shown in FIG. 7. Referring to FIG. 7, an electronic controller 82 (such as a computer, a microprocessor, programmable logic device/controller, or other suitable controller) has a plurality of inputs and conveyor system feedback which can be processed to track and group molds, and then used direct molds through one of the mold exits 22, 24.

Figure 8:
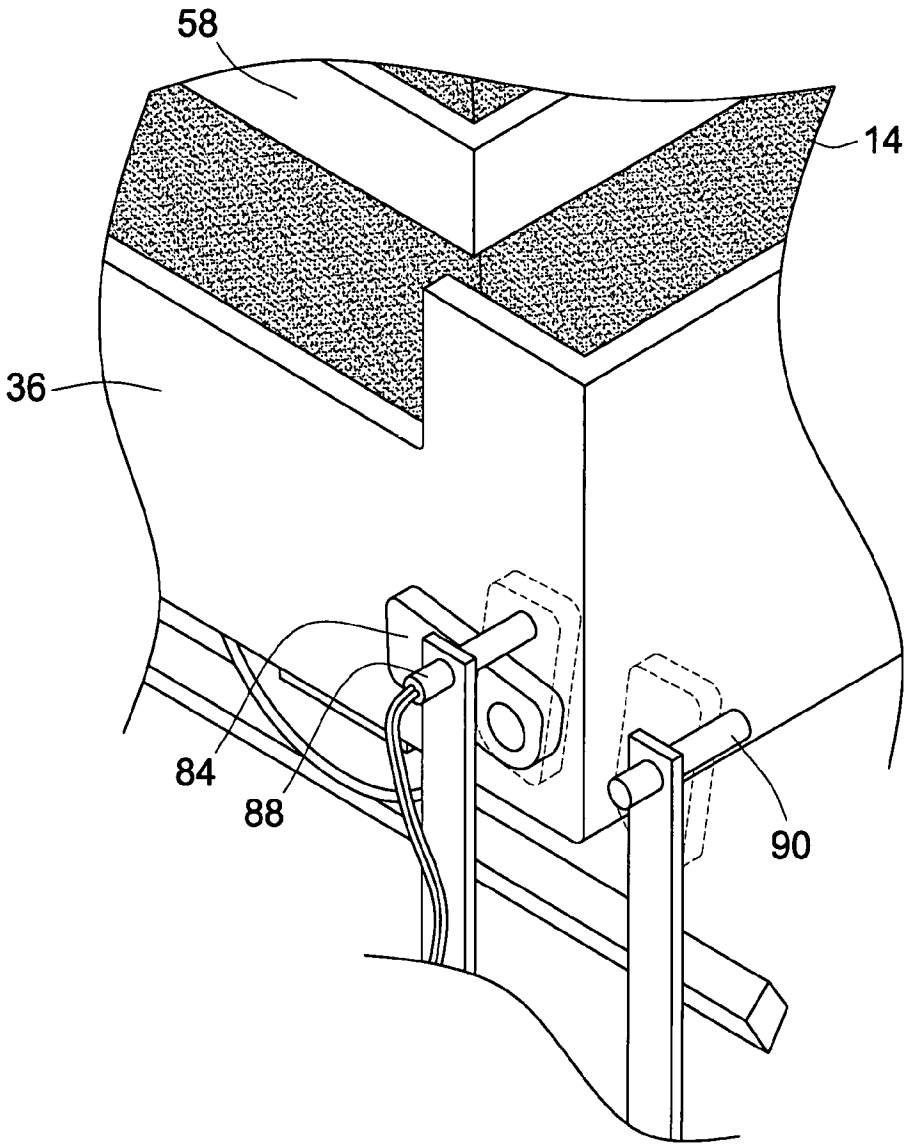
FIG. 8 is a perspective view of the flagging and sensing apparatus mounted to the pouring pallet and pouring conveyor for the mold handling system shown in FIG. 1.

For grouping molds 14, the mold handling system 10 includes flags 84 that can be moved between on and off positions as shown in FIG. 8. As shown, the flags 84 are pivotally mounted directly on the pouring pallets 36. However, the flags may also be mounted on other parts of a mold carrier such as on the weighted jackets 58. In use, the flags 84 may be raised to the on position at the pouring station 18 manually (such as by the worker performing molten metal pouring operations at the pouring station 18) to indicate a change has occurred. For example, for each new batch of metal carried in a ladle 86, a flag can be raised (e.g. by marking the first mold poured), which in turn can indicate that the group of molds behind the first leading flagged mold are poured with a common batch of a metallurgical mix contained in the ladle 86. This differentiates molds that have been poured by different batches of metal.

The purpose of differentiating different pours of metal is to segregate the molds into different groups. Sample blocks of molten metal can be taken from each ladle 86 to the lab to determine whether or not the metallurgical characteristic of each pour is of a predetermined metallurgical characteristic (e.g. whether a measured characteristic falls within a range of parameters). This can then identify quality products meeting the predetermined metallurgical characteristic and also inferior products that fail to meet the predetermined metallurgical characteristic. Improper temperature or mixing the metal at the wrong time can affect the metallurgical characteristic of each pour, and in fact each mixture has a slightly different metallurgical characteristic. Testing of sample blocks from each ladle is not instantaneous, but requires lab analysis which often takes up to about an hour in current commercial operations. This lag time is often great enough such that the molten metal batch has been depleted, but the molds poured by this batch are not fully cooled but are still being processed on the mold handling system 10, often at an intermediate to advanced cooling stage on the cooling conveyor 28. Once the metallurgical quality characteristic for each batch and therefore each group has been determined, the molds of different groups can be selectively directed toward either the second mold exit 24 or the first mold exit 22 to separate different quality levels of metal castings.

Alternatively, the flags 84 can be raised to identify problematic molds, or to indicate that a new mold type is being processed. Therefore, flags 84 may also be raised near the mold inlet 54 by or as instructed by workers working at the mold forming station 12. When used in this manner, the flags 84 may be used to indicate a test mold (typically the first mold formed according to a new mold forming parameter). After being subjected to some cooling, the test mold can be bypassed past the majority of mold locations on the cooling conveyor 28 and pushed all the way through the tray 46 at the transfer mechanism 30 by the hydraulic ram 64 to the first mold exit 22 for inspection. If the test mold is determined to be of satisfactory quality, molds 14 of the same group can be output through the normal mold exit 24 to the shakeout conveyor 72 for harvest. If on the other hand, the test mold is determined to be defective or of unsatisfactory quality, the molds 14 of this unsatisfactory quality may be segregated and output through the first mold exit 22 for recycling or other purposes so as to prevent mixing of lower quality castings with higher quality castings.

In the disclosed embodiment, a proximity sensor 88 is provided to sense the presence or absence of the flags 84. The proximity sensor 88 is in electrical communication with the electronic controller 82 to indicate which molds have been flagged. In operation, the flags 84 in the upright "on" position are sensed by the proximity sensor 88 as the pallets are conveyed past the sensor 88. A reset bar 90 downstream of the proximity sensor 88 returns or resets the flags 84 to the down or "off" position after "on" flags have been sensed.

Other input into the electronic controller 82 such as a manual input 80 or signals from the mold forming station 12 may be used to indicate molds 14 of a different characteristic. For example, each time a mold forming parameter (i.e. a new matchplate or new operational setting) is changed at the mold forming station 12, a signal may be sent to the electronic controller 82 to indicate such a resulting change in mold characteristics, which can then be utilized to initiate a first test mold sequence or for grouping of molds to ensure that molds are directed toward the desired mold exit.

Although flagged molds may be visually tracked, the disclosed embodiment also may provide for electronic tracking of molds 14. In this regard, conveyor size data 92 is input into the electronic controller 82 (usually as permanent or temporary memory). With a predetermined known number of mold locations 100 (e.g. one mold location 100 per pouring pallet and three mold locations 100*a*, 100*b*, 100*c* per cooling tray), and a predetermined number of pouring pallets 36 and cooling trays 46, and by monitoring the predetermined systematic indexing of molds 14 through the mold locations 100, the exact location of each mold can be electronically determined and monitored. As shown in FIG. 7, the electronic controller 82 receives position sensor input which may include inputs from separate pouring conveyor index sensors 94 and cooling conveyor index sensors 96 that signal the electronic controller 82 each time the pouring pallets 36 and mold trays 46 are indexed. With the size 92 of conveyors 26, 28 being set, there are therefore a predetermined number of indexes needed for a tray or pallet to reach and output location. The electronic controller 82 therefore can track and monitor molds as molds are conveyed along endless conveyor paths, and based on other inputs can automatically control and signal other actuators 38, 40, 48, 50, 60, 62 64, 68 as appropriate to guide molds to predetermined or selected locations.

With respect to the cooling conveyor, the transfer mechanism sensors 98 sense and/or are utilized to control the movement of the hydraulic push ram 64 of the transfer mechanism 30 to indicate position of the push ram 64 and whether a mold has be pushed to one of the three possible mold locations 100*a*, 100*b*, 100*c* on one of the cooling trays 46, or through the mold exit 22. Some of the transfer mechanism sensors 98 also sense and/or are utilized to control movement of the first hydraulic push room 62 and elevator 60. Likewise, an actuator output sensor 104 senses and/or is utilized to control movement of the hydraulic push ram 68 aligned the second mold exit 24.

The starting position where molds may be first tracked is the mold location 100 immediately adjacent and downstream of the flag proximity sensor 88. With the number of downstream mold locations known on the pouring conveyor 26, each time the pouring conveyor is indexed, the position of a flagged mold can be determined and thereby tracked. Thus, the electronic controller 82 knows when an individual mold reaches transfer mechanism, and by virtue of the transfer mechanism sensors 98, the electronic controller 82 knows when the individual mold is transferred onto a tray 46 and the specific mold location 100*a-c* on the tray 46. With the sensor input, the electronic controller 82 also knows if the mold bypasses the cooling conveyer 28 and is dumped through the mold exit 22 aligned with the transfer mechanism 30. With a predetermined number of trays 46, the electronic controller tracks the position of individual molds as the trays 46 are cycled around the cooling conveyor 28 along an endless path.

In addition or in the alternative, the starting position where molds may be first tracked can be located at the mold forming station 12 whereby molds are counted when individual molds are formed and counted as individual molds are moved onto the mold handling system 10. Molds can also be sensed by a proximity sensor 102 and therefore counted by the electronic controller 82 as molds 14 are moved onto the pouring conveyor 26 through the mold inlet 54. The electronic controller 82 can correlate the mold counts indicated by the proximity sensor 102 and the mold forming station 12 to keep track of different types of molds formed at the mold forming station 12.

Molds can be electronically grouped 108 and then electronically tracked 106 in groups. According to one operational mode, each time a mold characteristic is changed, a signal can be sent or a flag 84 raised for the first of the group having a common characteristic. For example, each time a new metallurgical batch of molten metal is poured from one or more ladles 86, the operator can manually raise a flag 84 for the leading first mold poured. A test block from the metal pour or ladle 86 may be taken to the lab for testing. In this manner, flags indicate a new metal pour for the following group of unflagged molds. Alternatively, grouping may be accomplished by flagging molds into two or more groups (e.g. flagged molds comprise one group of molds while unflagged molds comprise a second group of molds). The mold forming station 12 may also provide an affirmative signal to affirmatively indicate to the electronic controller 82 the group for which each newly formed mold belongs.

Grouping of molds does not necessarily mean that molds of a like characteristic are adjacent each other on the mold handling conveyor 20. For example, with the Hunter Molding Center™ commercially available from Hunter Automated Machinery Corporation, and the subject of U.S. patent application Ser. No. 10/133,824, filed on Apr. 26, 2002, two different mold flasks are provided such that molds of different characteristics may be alternately formed and therefore input alternately through the mold inlet 54 into the mold handling system 10. Further, with the Hunter Molding Center™, matchplates or patterns can be switched or alternatively run in the two different flasks, thereby allowing for different patterned types of sand molds, which can be separately grouped.

Figure 5:
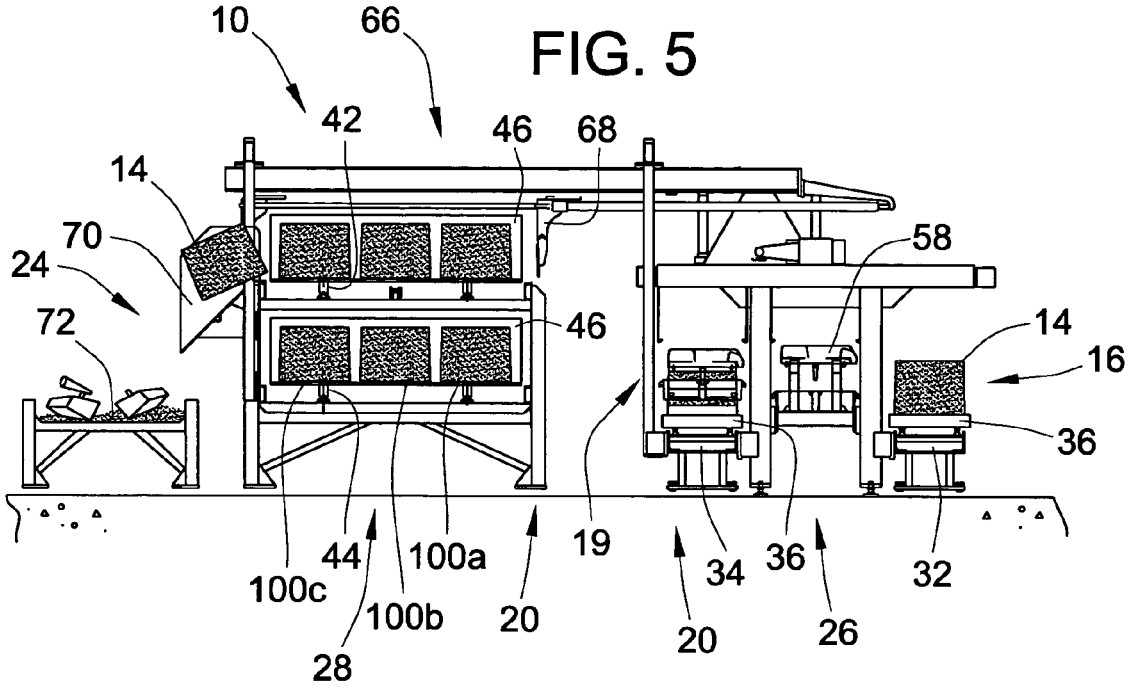
FIG. 5 is a cross section of the mold handling system shown in FIG. 2 taken about line 5-5.
Figure 6:
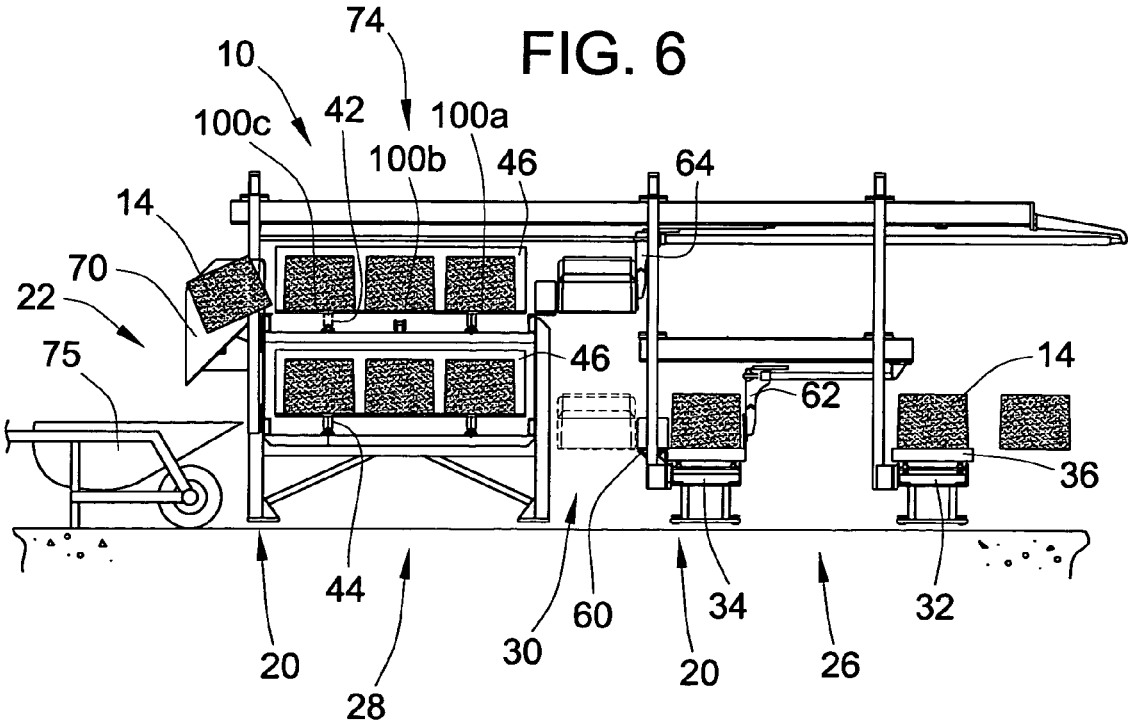
FIG. 6 is a cross section of the mold handling system shown in FIG. 2 taken about line 6-6.

As shown in FIG. 1, different mold exits 22, 24 may be each directed toward different shakeout conveyors 72, 73. Thus, if different types of molds 14 are being formed at the mold forming station 14 using different patterns to form different types of metal castings, the mold handling system 10 can group the different types of molds and direct those molds to the appropriate exit thereby separating the different types of castings. Thus the exits 22, 24 may be used for quality castings of different characteristics. Alternatively, as shown in FIGS. 5 and 6, at least one exit 22 may direct molds to a test and/or recycle bin 75 whereat molds can be dumped and castings can be tested and/or recycled.

With the disclosed embodiment of the present invention, different molds of different cooling times may also cycled together on the same mold handling system 10. Molds of longer cooling times may be arranged in a first group of trays 46 and cycled around the cooling conveyor 28 more than once, while molds of shorter cooling times may be arranged in a second group of trays 46 and cycled only once. The versatility of this allows the mold handling system to be used with different types of metals (with differing temperatures/cooling requirements) or different sizes of castings at the same time that have different cooling requirements. A foundry can be better suited to meet production output requirements to meet different needs as the system 10 does not need to be dedicated to one cooling time during but can accommodate different cooling time requirements at the same time.

Referring again to FIG. 7, the electronic controller 82 can also direct molds that it may group 108 and track 106 to desired mold exits 22, 24 based on manual input 80 or a predetermined program. By tracking molds 14, the electronic controller 82 knows when individual molds are in front of either of the mold exits 22, 24 and can operate the output actuators 64, 68 to direct molds of assigned characteristics to different mold exits 22, 24. The electronic controller 82 may also control the pouring conveyor indexing actuators 38, 40, the cooling conveyor actuators, 48, 50 and the transfer mechanism actuators 60, 62, in conjunction with the output actuators 64, 68 to ensure systematic cycling of molds through the mold handling system 10.

It should be noted that although separate dump chutes 70, 76 are dedicated for different mold exits 22, 24, that a single hydraulic ram and dump chute may be provided for both of the mold exits. For example, a single dump chute (not shown) may be actuated by a slide or pivot relative to the mold handling conveyor between two or more different mold exit locations to provide different output options. The dump chutes may also be eliminated with exits position closer to the cooling conveyor. In addition, one of the exits or an additional exit may be located on the pouring conveyor 26 to provide for inspection of first molds through the system, to provide an output for defective molds, or for any other suitable purpose.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for processing and handling sand molds produced at a sand mold forming station, comprising:

transporting sand molds of at least two different mold characteristics with a mold handling system;

pouring molten material into the sand molds for forming castings;

changing a mold forming parameter at the mold forming station;

bypassing at least one test mold made with the changed mold forming parameter past a majority of the mold positions on the mold handling system to a first mold exit when said change of the mold forming parameter is made for inspection purposes;

employing a first output actuator to output sand molds having a first mold characteristic to the first mold exit; and employing a second output actuator to output sand molds having a second mold characteristic to a second mold exit.

2. The method of claim 1 further comprising:

segregating the sand molds of different mold characteristics into at least two groups; and tracking the at least two groups of sand molds as the sand molds are transported by the mold handling system.

3. The method of claim 1 further comprising:

evaluating at least one parameter selected from the group comprising molten material, castings, or sand molds for selected sand molds, to determine if castings contained in sand molds are quality product or waste product;

characterizing sand molds based upon said evaluation as being of either of the first or second mold characteristics.

4. The method of claim 3 wherein said pouring utilizes a plurality of different batches of molten metal, wherein said evaluating comprises testing molten material of the batches being poured into different groups of sand molds to determine whether castings contained in the sand molds have a predetermined metallurgical characteristic.

5. The method of claim 1 wherein the second mold exit leads to a shakeout conveyor for harvest of castings contained in the sand molds, wherein said transporting includes systematically conveying sand molds through a plurality of mold positions on the mold handling system, poured molten material into the sand molds being cooled as sand molds arc systematically conveyed through the plurality of mold positions toward the second mold exit, and inspecting the at least one test mold to determine whether the sand molds meet a quality characteristic.

6. The method of claim 5 wherein said outputting comprises:

outputting sand molds to the second mold exit toward the shakeout conveyor when the sand molds are determined to meet the quality characteristic; and outputting sand molds to the first mold exit when the molds do not meet the quality characteristic.

7. The method of claim 5 wherein at least two different types of sand molds are formed at the mold forming station for producing different types of metal castings, each different type of sand mold providing a different mold characteristic.

8. The method of claim 7 Further comprising:

signaling when a change is made between the at least two different types of sand molds, thereby providing for said first and second mold characteristics; and responding to said signaling to perform said bypassing.

9. The method of claim 1, wherein the sand molds of the first and second mold characteristics have different cooling time period requirements, respectively, further comprising retaining the first group of sand molds having on the mold handling system for a longer time period than the second group of sand molds.

10. The method of claim 9 wherein said pouring comprises pouring a first type of metal into the first group of the sand molds and pouring a second type of metal into the second group of sand molds, thereby providing the sand molds with different mold characteristics, the first and second types of metals having different cooling times.

11. The method of claim 1 further comprising:

placing sand molds on pouring pallets prior to said pouring;

conveying pouring pallets on an endless pouring conveyor;

transferring sand molds from the pouring pallets to cooling pallets on an endless cooling conveyor, wherein the first and second mold exits are provided at different locations adjacent the endless cooling conveyor; and conveying cooling pallets on the endless cooling conveyor.

12. The method of claim 1 further comprising:

selectively grouping sand molds into at least two different groups with flag elements;

electronically sensing the flag elements;

electronically monitoring said placing, conveying and transferring to electronically track the at least two different groups;

assigning a mold characteristic for each different group; and selectively outputting the at least two different groups to the mold exits based upon the mold characteristic for each group.

13. The method of claim 12 wherein said pouring is conducted with a plurality of batches of molten metal pours, said flagging being conducted near the time of said pouring to indicate each different batch of molten metal pours.

14. A method for processing and handling sand molds produced at a sand mold forming station, comprising:

transporting sand molds with a mold handling system having an endless cooling conveyor;

pouring molten material into the sand molds for forming castings;

segregating the sand molds into at least two groups;

tracking the at least two groups of sand molds as the sand molds are transported by the mold handling system;

cycling a first group of the at least two groups of sand molds once around the endless cooling conveyor;

cycling a second group of the at least two groups of sand molds more than once wound the endless cooling conveyor;

selectively outputting the at least two groups of sand molds from the mold handling system to one of at least two different mold exits;

changing a mold forming parameter at the sand mold forming station; and bypassing at least one test mold made with the changed mold forming parameter across the endless cooling conveyor to one of the at least two different mold exits without cycling the test mold around the cooling conveyor.

15. The method of claim 14 further comprising inspecting the at least one test mold to determine quality characteristics for different groups of sand molds.

16. The method of claim 14 wherein said segregating comprises:

evaluating at least one parameter selected from the group comprising molten material, castings, or sand molds for selected sand molds, to determine if castings contained in the at least two groups of sand molds are quality product or waste product; and directing sand molds containing quality product to a first of the mold exits toward a shake out conveyor for harvest of castings, and directing sand molds containing waste product to a second of the mold exits.

17. The method of claim 16 wherein said pouring utilizes a plurality of different batches of molten metal, wherein said evaluating comprises testing molten material of the batches being poured into different groups of sand molds to determine whether castings contained in the sand molds have a predetermined metallurgical characteristic.

18. The method of claim 16 wherein at least two different types of sand molds are formed at the mold forming station for producing different types of metal castings, each different type of sand molds making up a different group for segregation.

19. The method of claim 18 further comprising producing a signal when a switch is made at the mold forming station between the at least two different types of sand molds, thereby providing for said tracking, further comprising inspecting the sand molds to determine whether cavities formed in sand molds are of a predetermined characteristic.

20. The method of claim 14, wherein the at least two groups of sand molds include first and second groups have different cooling time period requirements.

21. The method of claim 20 wherein said pouring comprises pouring a first type of metal into the first group of the sand molds and pouring a second type of metal into the second group of sand molds, the first and second types of metals having different cooling times.

22. The method of claim 14 further comprising:

placing sand molds on pouring pallets prior to said pouring;

conveying pouring pallets on an endless pouring conveyor;

transferring sand molds from the pouring pallets to cooling pallets on the endless cooling conveyor, wherein the first and second mold exits are provided at different locations adjacent the endless cooling conveyor; and conveying the cooling pallets on the endless cooling conveyor.

23. The method of claim 22, further comprising:

selectively grouping sand molds into said at least two different groups with flag elements;

electronically sensing the flag elements to establish a known location for molds of each group;

electronically monitoring said placing, conveying and transferring to electronically track the at least two different groups as the groups progress from thc known location;

assigning a mold characteristic for each different group; and selectively outputting the at least two different groups to the mold exits based upon the mold characteristic for each group.

24. The method of claim 14 further comprising:

selectively flagging sand molds with flags to indicate which groups for which the sand molds belong; and electronically sensing the flags and electronically monitoring said transporting to track the at least two groups of sand molds.

25. The method of claim 24 wherein said pouring is conducted with a plurality of batches of molten metal pours, said flagging indicating each different batch of molten metal pours.

26. The method of claim 14 wherein at least two different types of sand molds are formed at the mold forming station for producing different types of metal castings, each different type of sand molds making up a different group for segregation, wherein different dedicated exits are provided for each different type of sand mold.

27. A method for processing and handling sand molds produced at a sand mold forming station, comprising:

transporting sand molds with a mold handling system;

pouring molten material into two different mold flasks so as to alternately form two different types of sand molds for forming two different types of castings;

changing a mold forming parameter at the mold forming station;

bypassing at least one test mold made with the changed mold forming parameter past a majority of the mold positions on the mold handling system to a first mold exit when said change of the mold forming parameter is made for inspection purposes;

tracking the sand molds as the sand molds are transported by the mold handling system; and alternately outputting sand molds from the mold handling system to first and second exits so as to output a first type of sand mold to the first exit and a second type of sand mold to a second exit.

28. A method for processing and handling sand molds produced at a sand mold forming station, comprising:

transporting sand molds with a mold handling system having an endless cooling conveyor;

pouring molten material into the sand molds for forming castings;

guiding sand molds onto the endless cooling conveyor;

cycling sand molds around the endless cooling conveyor;

outputting sand molds from the endless cooling conveyor to a first mold exit;

changing a mold forming parameter at the sand mold forming station; and bypassing at least one test mold made with the changed mold forming parameter across the endless cooling conveyor to a second mold exit without cycling the test mold around the cooling conveyor.

* * * * *